US010028598B2

(12) United States Patent
Bacallao et al.

(10) Patent No.: US 10,028,598 B2
(45) Date of Patent: Jul. 24, 2018

(54) BAG RETAINING FIXTURE

(71) Applicant: Wal-Mart Stores, Inc., Bentonville, AR (US)

(72) Inventors: Yurgis Mauro Bacallao, Centerton, AR (US); Douglas E. Humphrys, Bentonville, AR (US); John Levy, Fayetteville, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/695,401

(22) Filed: Sep. 5, 2017

(65) Prior Publication Data

US 2018/0064266 A1 Mar. 8, 2018

Related U.S. Application Data

(60) Provisional application No. 62/385,097, filed on Sep. 8, 2016, provisional application No. 62/385,108, filed on Sep. 8, 2016.

(51) Int. Cl.
*A47F 5/01* (2006.01)
*A47F 9/04* (2006.01)
(Continued)

(52) U.S. Cl.
CPC ..... *A47F 9/042* (2013.01); *A47F 5/01* (2013.01); *A47F 7/00* (2013.01); *B65B 67/1227* (2013.01); *B65B 67/1233* (2013.01)

(58) Field of Classification Search
CPC ..... A47F 5/00; A47F 5/01; A47F 5/14; A47F 7/00; A47F 9/04; B65B 67/1227; B65B 67/1233; B65B 2067/1294
See application file for complete search history.

(56) References Cited

U.S. PATENT DOCUMENTS

D473,099 S 4/1892 Vincentz
D721,996 S 3/1903 Farcas et al.
(Continued)

FOREIGN PATENT DOCUMENTS

JP 6096712 B2 3/2017
WO 2006130911 A1 12/2006

OTHER PUBLICATIONS

Weimaamerica, "Carousel Bagging System for WEIMA Briquette Press," YouTube.com, Apr. 15, 2009.
(Continued)

*Primary Examiner* — Mark J Beauchaine
(74) *Attorney, Agent, or Firm* — Schmeiser, Olsen & Watts LLP

(57) ABSTRACT

Described is a cabinet for holding paper bags at a bagging station in a retail store, and a bag retaining fixture mounted inside the cabinet. The cabinet holds a stack of paper bags, and the bag retaining fixture secures the stack of paper bags inside the cabinet. The cabinet housing can be mounted to or near the bagging station. The bag retaining fixture is coupled to an inner surface of the cabinet. The bag retaining fixture includes a plate and an elongate wire coupled to the plate. The elongate wire puts pressure on the stack of paper bags to hold them in place as individual paper bags are removed for filling. The cabinet for holding paper bags and the bag retaining fixture keep the stack of paper bags from being scattered as the paper bags are stored and dispensed.

21 Claims, 7 Drawing Sheets

(51) Int. Cl.
*B65B 67/12* (2006.01)
*A47F 7/00* (2006.01)

(56) References Cited

U.S. PATENT DOCUMENTS

| | | | | |
|---|---|---|---|---|
| D743,547 | S | | 7/1903 | Nix |
| 1,754,327 | A | | 4/1930 | Leonard |
| 2,324,596 | A | | 7/1943 | Quain |
| 3,055,508 | A | | 9/1962 | Reeser |
| 3,175,793 | A | | 3/1965 | Kennedy |
| 3,628,632 | A | | 12/1971 | Lambert |
| 3,838,839 | A | | 10/1974 | Spencer |
| 3,847,332 | A | | 11/1974 | Murai |
| 4,106,733 | A | | 8/1978 | Walitalo |
| 4,106,734 | A | | 8/1978 | Walitalo |
| 4,398,689 | A | | 8/1983 | Prader |
| 4,498,652 | A | * | 2/1985 | Malik ..... B65B 67/1227 248/99 |
| RE33,122 | E | | 12/1989 | Orem |
| 5,012,994 | A | | 5/1991 | Keefe |
| 5,054,728 | A | | 10/1991 | Nigro |
| 5,131,499 | A | | 7/1992 | Hoar |
| 5,462,178 | A | | 10/1995 | Wallach et al. |
| 5,467,572 | A | | 11/1995 | Wile et al. |
| 5,885,002 | A | | 3/1999 | Reiss |
| 6,474,478 | B1 | * | 11/2002 | Huehner ..... A47F 5/0861 211/4 |
| 6,491,218 | B2 | | 12/2002 | Nguyen |
| 6,550,583 | B1 | | 4/2003 | Brenhouse |
| 7,516,820 | B1 | | 4/2009 | Cox |
| 7,753,588 | B2 | | 7/2010 | Bazbaz |
| 7,866,546 | B1 | | 1/2011 | Vance |
| 8,400,324 | B1 | | 3/2013 | Jaeger |
| 8,678,281 | B2 | | 3/2014 | Kangas et al. |
| 9,101,232 | B1 | | 8/2015 | Newman |
| 9,622,598 | B1 | | 4/2017 | Davis, Jr. |
| 9,622,599 | B2 | | 4/2017 | Davis, Jr. |
| 9,750,356 | B2 | | 9/2017 | Tan |
| 2004/0112850 | A1 | | 6/2004 | Jordan |
| 2005/0114216 | A1 | | 5/2005 | Lantz et al. |
| 2005/0258177 | A1 | | 11/2005 | Woodson |
| 2007/0181753 | A1 | | 8/2007 | Herlands |
| 2009/0289019 | A1 | | 11/2009 | Alvarado et al. |
| 2010/0021088 | A1 | | 1/2010 | Wilfong, Jr. |
| 2010/0096514 | A1 | | 4/2010 | Adair et al. |
| 2010/0148019 | A1 | | 6/2010 | Simhaee |
| 2010/0314507 | A1 | | 12/2010 | Laitila et al. |
| 2011/0266092 | A1 | | 11/2011 | Marquis et al. |
| 2013/0223766 | A1 | | 8/2013 | Gebhardt |
| 2013/0259405 | A1 | | 10/2013 | Jack |
| 2014/0138499 | A1 | | 5/2014 | Laitila et al. |
| 2015/0048039 | A1 | | 2/2015 | Laitila et al. |
| 2017/0020307 | A1 | | 1/2017 | Davis, Jr. |
| 2017/0217621 | A1 | | 8/2017 | Robinson et al. |
| 2017/0280900 | A1 | | 10/2017 | Bacallao |

OTHER PUBLICATIONS

Web page image 1, accessed Dec. 29, 2015, https://www.google.co.in/imgres?imgurl=https://c1.staticflickr.com/3/2932/14248018844_89e3d89fa4_b.jpg&imgrefurl=https://www.flickr.com/photos/ieepersmedia/14248018844&h=950&w=1024&tbnid=MyLI_TOn6HIMCM:&docid=9feoV3Exk3O-4M&ei=jfyAVsbyJMPluASeoa6QBw&tbm=isch&ved=0ahUKEwiG7Z7tmv7JAhVDJI4KHZ6QC3IQMwgkKAkwCQ.

Web page image 2, accessed Dec. 29, 2015, https://www.flickr.com/photos/fourstarcashiemathan/6979145827.

"Over Door Bag Holder Waste Bin, Hang Over Kitchen Door, Reuses Shopping Bags," Klife, Ebay.com, accessed on May 23, 2016; 4 pages.

"100mm metal wire clip/clipboard clip," Dongguan Taoyuan Stationary Co., Ltd., Sell.Lulusoso.com, accessed May 20, 2016; 4 pages.

Non-Final Office Action in U.S. Appl. No. 15/415,026, dated Dec. 28, 2017; 8 pages.

Non-Final Office Action for U.S. Appl. No. 15/695,306, dated Apr. 18, 2018. (11 pages).

Notice of Allowance in U.S. Appl. No. 15/415,026 dated May 21, 2018; 6 pages.

* cited by examiner

BAG RETAINING FIXTURE

CROSS REFERENCE TO RELATED APPLICATION

This invention claims priority to U.S. provisional patent application Ser. No. 62/385,097, filed Sep. 8, 2016 to Applicant Wal-Mart Stores Inc., and entitled "Paper Bag Retaining Fixture", and to U.S. provisional patent application Ser. No. 62/385,108, filed Sep. 8, 2016 to Applicant Wal-Mart Stores Inc., and entitled "Bag Retaining Fixture", both of which are incorporated entirely herein by reference.

BACKGROUND OF THE INVENTION

Technical Field

This invention relates to fixtures for retail stores, and specifically to a fixture for holding a stack of paper bags at a bagging station of a retail store.

State of the Art

A bagging station is a fixture in a retail store where purchased items are loaded into bags so the items can be carried out of the store by the customer. Bagging stations are often at checkout registers where purchased items are paid for. Bagging stations are usually designed for use with plastic shopping bags. When paper bags are being dispensed at a bagging station instead of plastic bags, the paper bags are usually stacked in a pile on a surface of the bagging station. It is often difficult for a person bagging items to remove one paper bag from the stack of paper bags without disrupting the whole stack of paper bags and scattering the paper bags. Thus, it is desirable to have a cabinet for storing paper bags at or near the bagging station. Additionally, it is desirable to have a bag retaining fixture that holds the stack of paper bags in place even as one or more paper bags are removed from the stack for filling.

DETAILED DESCRIPTION OF EMBODIMENTS OF THE INVENTION

As discussed above, embodiments of the present invention relate to fixtures for retail stores, and specifically to a fixture for holding a stack of paper bags at a bagging station of a retail store.

Retail stores make use of bagging stations for dispensing bags for carrying purchased items from the store. Once a customer has purchased an item, either the customer or a store employee places the item in a bag. The bagging station holds and dispenses bags for this purpose. Bagging stations are commonly designed to dispense plastic bags, but in some areas, it is desirable to use paper bags instead of plastic bags. When paper bags are used at a bagging station designed for plastic bags, it is desirable to have a cabinet to hold the paper bags so the stack of paper bags does not sit on a surface where it can be scattered. In addition, it is desirable to have a bag retaining fixture that holds the stack of paper bags in place as one or more paper bags is removed from the stack. The term "paper bags" in this document refers to bags made from a semi-rigid material. The material is usually paper, as with traditional brown paper bags. But bags made from semi-rigid materials are also available that are made from plastic or composite materials. Paper bags are often distinguished from their traditional plastic shopping bag counterparts by the fact that paper bags can stand up on their own on a surface when open. Traditional plastic shopping bags cannot stand up on their own, but need to be hung from a bagging station when being filled.

Described herein is a bagging station that includes a cabinet for holding paper bags, and a bag retaining fixture for securing a bag or a stack of paper bags inside the cabinet. The cabinet includes a cabinet housing that holds one or more paper bags. The cabinet housing can be mounted at or near a bagging station. Described herein is an embodiment where the cabinet housing is mounted inside a center piece of the bagging station. Also described is a bag retaining fixture that holds on bag or a stack of bags in place in the cabinet. The bag retaining fixture is coupled to an inner surface of the cabinet. The bag retaining fixture includes a plate and an elongate wire. The plate couples the elongate wire to the cabinet. The elongate wire holds the stack of paper bags in place as one or more paper bags is removed from the stack. The cabinet for holding paper bags and the bag retaining fixture keep the stack of paper bags from being scattered as the paper bags are stored and dispensed.

Figure 1:
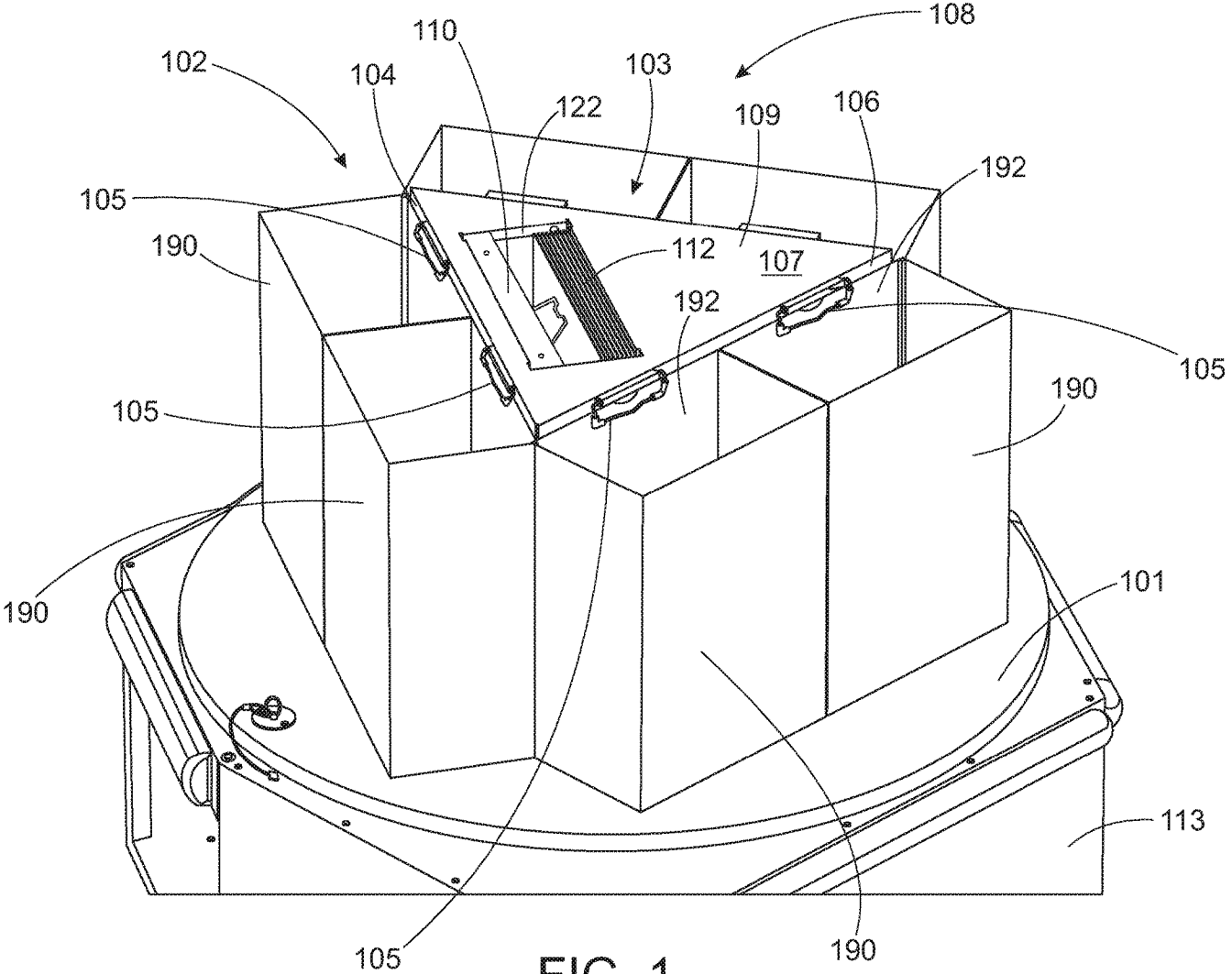
FIG. 1 shows a perspective view of a bagging station with a cabinet for holding a stack of paper bags.
Figure 2:
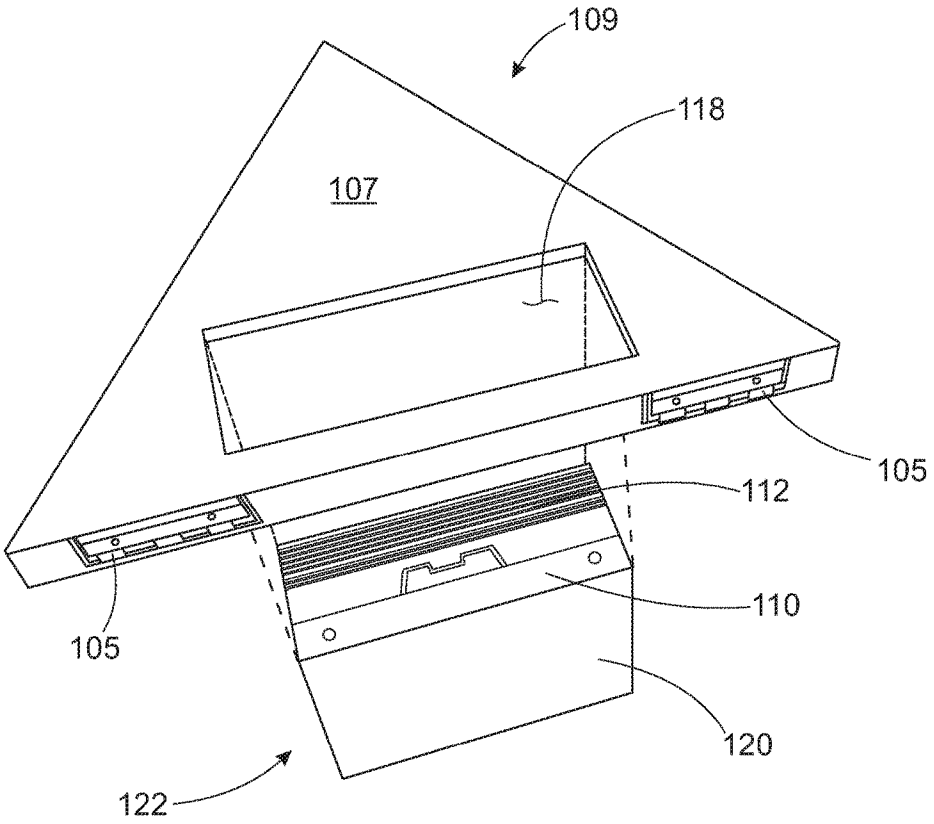
FIG. 2 shows an exploded view of a lid of the bagging station of FIG. 1 and a cabinet for holding paper bags.

FIG. 1 shows a bagging station 108 with a cabinet 122 for holding a stack of paper bags 112 mounted in bagging station 108. FIG. 2 shows an exploded view of center piece lid 109 of bagging station 108, and cabinet 122 for holding a stack of paper bags 112. Cabinet 122 includes a bag retaining fixture 110 that holds the stack of paper bags 112 in cabinet 122. FIG. 1 shows bag retaining fixture 110 holding stack of paper bags 112 in cabinet 122, but it is to be understood that bag retaining fixture 110 and cabinet 122 can hold one or more bags.

Bagging station 108 is a carousel-type bagging station that is often used at a checkout register of a retail store for bagging items that have been purchased in the retail store. Bagging station 108 includes a bagging station carousel 102 that includes a rotating platform 101 and a center piece 103. Bagging station carousel 102 sits on a base 113 as shown in FIG. 1. Center piece 103 sits on rotating platform 101 and rotates to make filling bags easier. Center piece 103 is triangular shaped in this embodiment, with three sides including a first side 104 and a second side 106, for holding bags. Center piece 103 has a number of clips 105 on its sides, such as first side 104 and second side 106 as shown in FIG. 1. Clips 105 are used to hold open paper bags 190 as shown. Each clip 105 holds a side 192 of a paper bag 190 between clip 105 and the side 104 or 106 of center piece 103. Rotating platform 101 rotates to allow the bagger to place items in paper bags 190 as they are purchased, without the bagger having to walk around the bagging station. Paper bags 190 that are full can be removed from bagging station 108 and carried out of the retail store. Once a paper bag 190 is removed, an empty paper bag 190 can be retrieved from stack of paper bags 112, opened, and put in place on bagging station carousel 102 for filling.

Bagging station 108 includes cabinet 122 for holding at least one paper bag, which, in this embodiment, is stack of paper bags 112. Cabinet 122 provides a place to store stack of paper bags 112 so that stack of paper bags 112 do sit on top of center piece 103 or somewhere else near bagging station 108. If stack of paper bags 112 are not kept in an enclosure such as cabinet 122, stack of paper bags 112 are easily scattered, which results in a messy bagging station, and paper bags 190 being trampled, damaged, or lost. Cabinet 122 is mounted beneath an opening 118 in lid top surface 107 of center piece 103, as shown in FIG. 1 and FIG. 2. Lid top surface 107 has a rectangular opening 118 as shown in FIG. 2, in this embodiment. Cabinet 122 includes rectangular cabinet housing 120 that is coupled to a bottom surface of lid 109 beneath opening 118, as shown in FIG. 2, and holds stack of paper bags 112, as shown in FIG. 1 and FIG. 2. Opening 118 through lid top surface 107 and into cabinet 122 allows stack of paper bags 112 to be accessed. Cabinet housing 120 holds stack of paper bags 112 so that stack of paper bags 112 is easily accessed by a bagger using bagging station 108. It is to be understood that cabinet 122 and cabinet housing 120 can be mounted to bagging station 108 in other positions. In some embodiments, cabinet 122 is mounted inside of bagging station 108 in other locations than what is shown in the figures. In some embodiments, cabinet 122 is mounted to the outside of bagging station 108. In some embodiments, cabinet 122 is mounted near bagging station 108. Cabinet 122 can be mounted to or near bagging station 108 so that stack of paper bags 112 inside of cabinet 122 are accessible to a person using bagging station 108. It is also to be understood that cabinet 122 can be shapes and sizes different from what is shown in the figures. Cabinet 122 can be any shape that will hold stack of paper bags 112.

Bagging station 108 includes bag retaining fixture 110. Bag retaining fixture 110 is coupled to an inner surface 124 of cabinet 122. Bag retaining fixture 110 is used to keep stack of paper bags 112 in place in cabinet 122 as an individual paper bag 190 is removed from stack of paper bags 112. Without bag retaining fixture 110, individual paper bags 190 would fall out of cabinet 122 easily, and, when an individual paper bag 190 is removed, other paper bags would slide out also, creating a messy environment and possibly causing damage or loss of paper bags.

Figure 3:
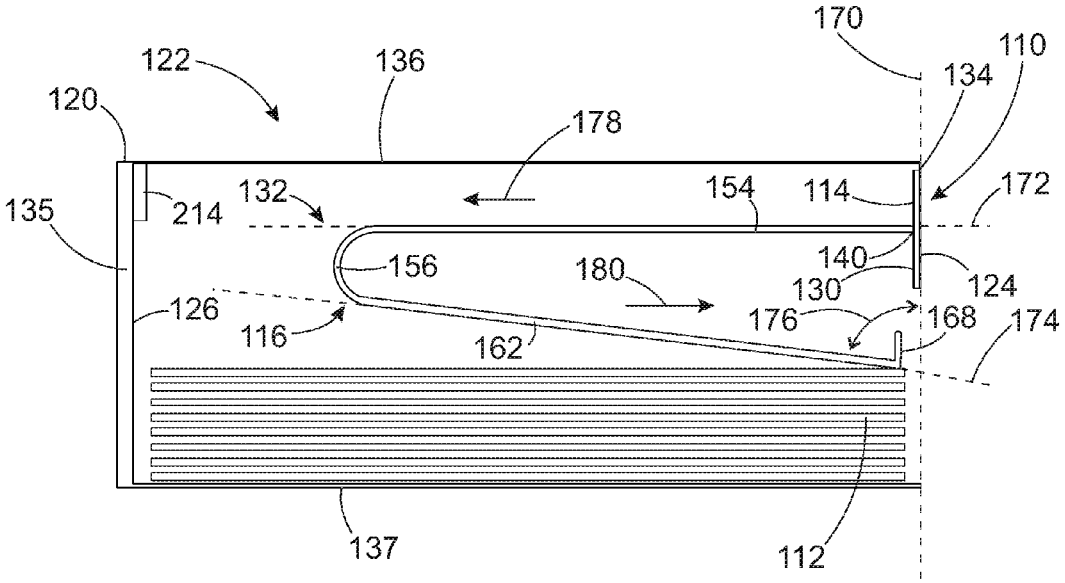
FIG. 3 shows a side cross-sectional view of a cabinet for holding paper bags, with a bag retaining fixture mounted inside the cabinet.
Figure 4:
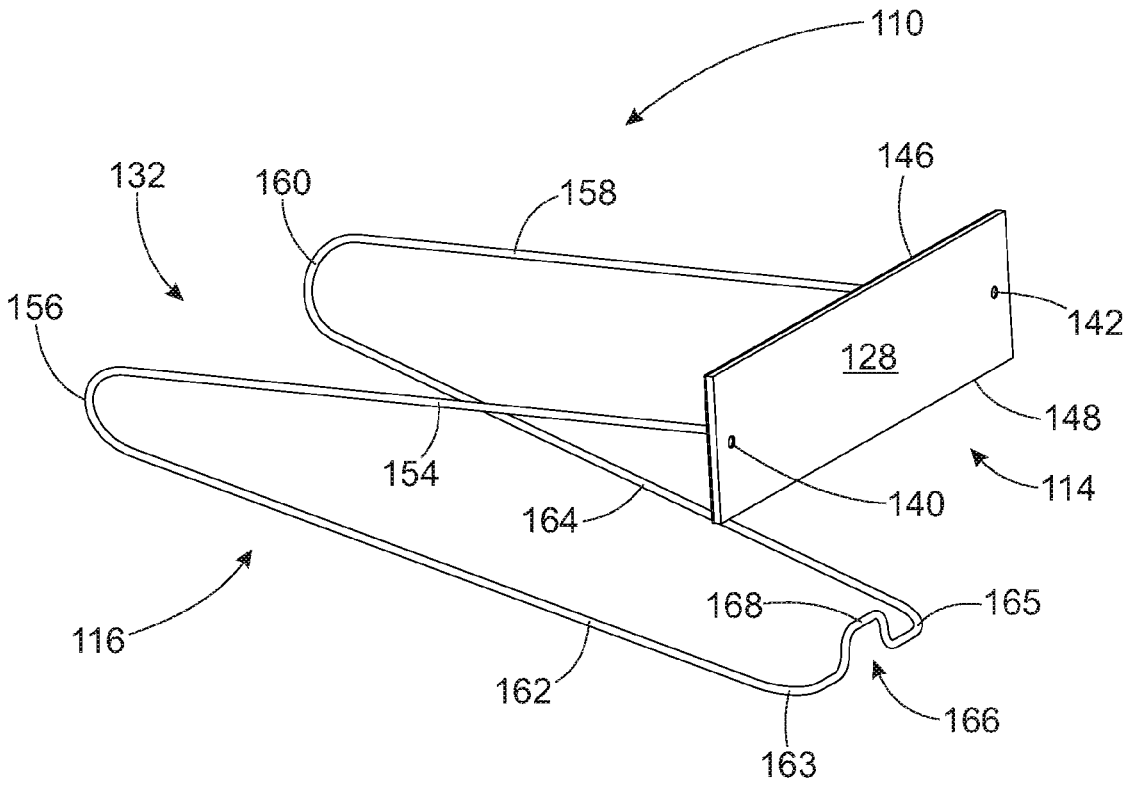
FIG. 4 shows a perspective view of the bag retaining fixture of FIG. 3.
Figure 5:
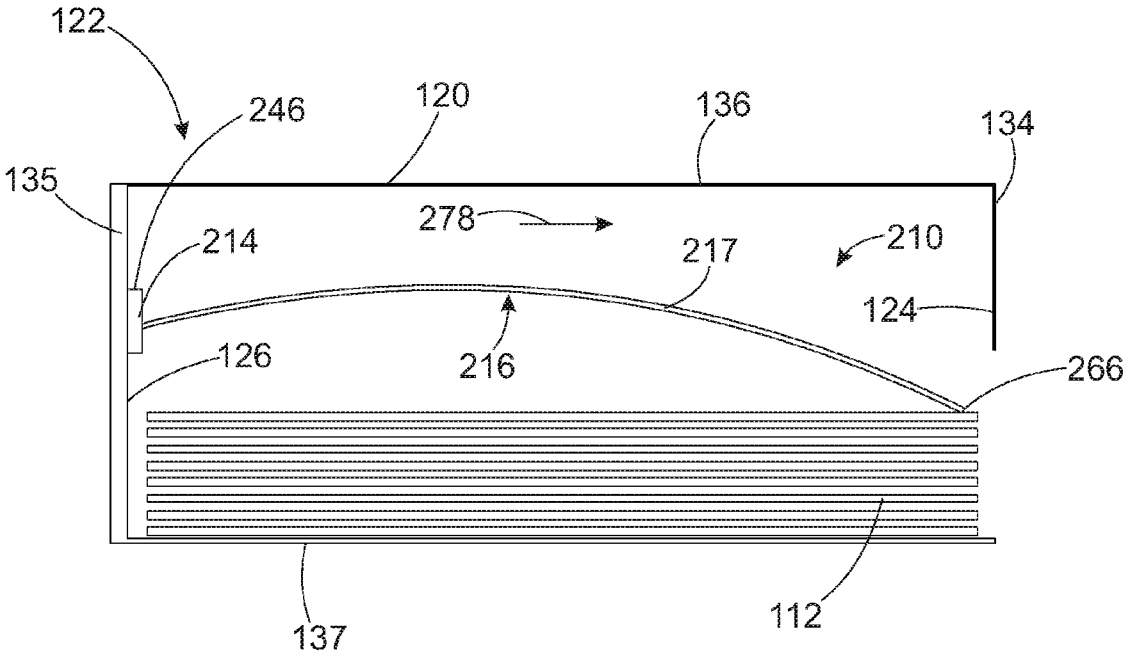
FIG. 5 shows a side cross-sectional view of a further embodiment of a cabinet for holding paper bags, with a further embodiment of a bag retaining fixture.
Figure 6:
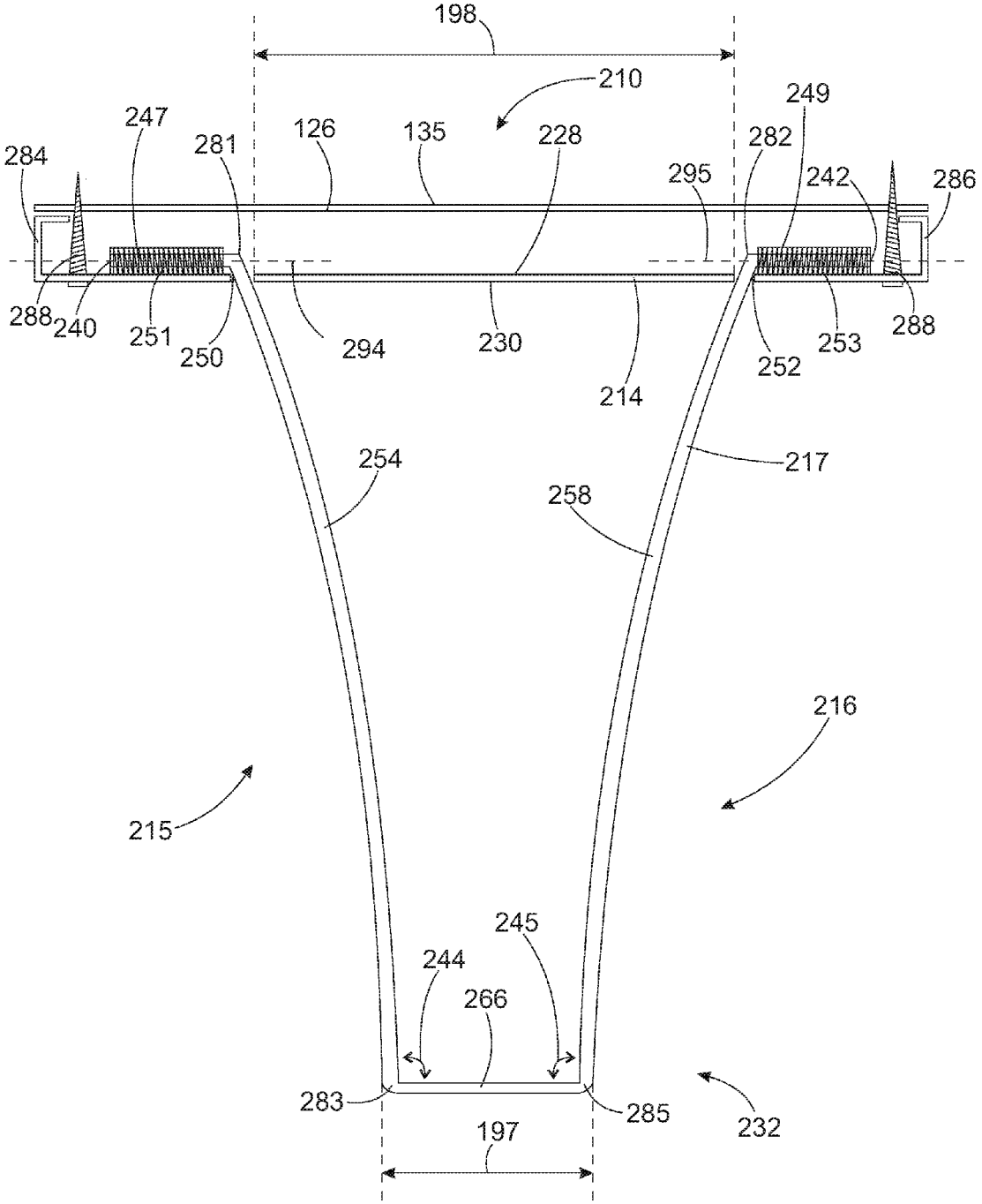
FIG. 6 shows a top view of the bag retaining fixture of FIG. 5.

FIG. 3 through FIG. 6 show details of embodiments of bag retaining fixtures. FIG. 3 and FIG. 4 show details of bag retaining fixture 110 used in bagging station 108 as shown in FIG. 1 and FIG. 2. FIG. 5 and FIG. 6 shows an embodiment of a bag retaining fixture 210 that can be used in place of bag retaining fixture 110 in bagging station 108 of FIG. 1 and FIG. 2.

FIG. 3 shows a cross section of cabinet 122 of FIG. 1 and FIG. 2, with bag retaining fixture 110 and stack of paper bags 112. Bag retaining fixture 110 captures stack of paper bags 112 between bag retaining fixture 110 and a bottom side 137 of cabinet housing 120. This keeps stack of paper bags 112 in place even as an individual paper bag is removed from stack of paper bags 112. FIG. 4 shows a perspective view of bag retaining fixture 110.

Bag retaining fixture 110 includes a plate 114 and an elongate wire 116 coupled to plate 114, as shown in FIG. 3 and FIG. 4. Plate 114 is formed of a rigid material. Plate 116 is formed of metal in this embodiment, but this is not meant to be limiting. Plate 114 is a flat plate in this embodiment, but this is not meant to be limiting. Plate 114 can have bends or be shaped, in some embodiments, such as plate 214 shown in FIG. 5 and FIG. 6. Plate 114 is rectangular shaped in this embodiment, but this is not meant to be limiting. Plate 114 includes a plate front surface 130, a plate rear surface 128 opposing plate front surface 130, a plate top edge 146 and a bottom edge 148 opposing plate top edge 146 (FIG. 4). Plate 114 lies in a plate plane 170 (FIG. 3). Plate 114 couples elongate wire 116 to cabinet housing 120. In this embodiment, plate rear surface 128 is coupled to housing 120. Elongate wire 116 protrudes from plate front surface 130 of plate 114.

Plate 114 is coupled to an inner surface of cabinet housing 120. In the embodiment shown in FIG. 3, plate 114 is coupled to an inner surface 124 of a front side 134 of cabinet housing 120, but this is not meant to be limiting. Depending on the configuration of cabinet 122 and how it is mounted to or near bagging station 108, plate 114 of bag retaining fixture 110 can be mounted to any inner surface of cabinet housing 120. Plate 114 can be mounted to back side 135 of housing 120, to top side 136 of housing 120, or to bottom side 137 of housing 120, for example but not by way of limitation. Plate 114 is what holds elongate wire 116 in place in cabinet housing 120, and what couples bag retaining device 110 to cabinet housing 120.

Elongate wire 116 is a semi-rigid metal wire in this embodiment. Elongate wire 116 can be a rigid wire formed in the needed shape, or a semi-rigid wire that is bent into the needed shape. Elongate wire 116 is rigid or semi-rigid so that elongate wire 116 can put pressure on stack of paper bag 112 to hold stack of paper bags 112 in place. The rigid or semi-rigid structure of elongate wire 116 acts like a spring to put pressure on stack of paper bags 112. Elongate wire 116 is bent or formed in a shape that will put pressure on stack of paper bags 112 to hold stack of paper bags 112 in place as individual bags are removed, as shown in FIG. 1 through FIG. 3. Elongate wire 116 is rigid enough to hold its shape and put pressure on stack of paper bags 112, but flexible enough to allow individual bags to be removed from stack of paper bags 112. Elongate wire 116 includes a plurality of bends 132 that are designed to hold stack of paper bags 112 in place while allowing individual paper bags to be removed without scattering stack of paper bags 112. Elongate wire 116 can be a wire, a semi-rigid rod, for example but not by way of limitation, can be made of metal or plastic or any material that can be formed and hold its shape to hold stack of paper bags 112 in place, while still allowing individual paper bags to be removed from stack of paper bags 112.

Elongate wire 116 includes a first end 140, and a second end 142 opposing first end 140. First end 140 and second end 142 are coupled to plate 114. Plurality of bends 132 are in elongate wire 116 between first end 140 and second end 142. Elongate wire 116 is coupled to plate 114 such that elongate wire 116 extends, or protrudes, from plate front surface 130 of plate 114, and so that elongate wire 116 captures stack of paper bags 112 between elongate wire 116 and side 137 of cabinet housing 120, as shown in FIG. 3.

Elongate wire 116, in the embodiment shown in FIG. 3 and FIG. 4, includes a first arm 154 and a second arm 158. First and second arm 154 and 158 both protrude from plate front surface 130 in a direction 178 away from, and approximately perpendicular to, plate plane 170. First arm 154 and second arm 158 are approximately parallel to each other in this embodiment, and lie in a first plane 172 (FIG. 3). First plane 172 is approximately perpendicular to plate plane 170.

First arm 154 is coupled to plate 114 at first end 140. First arm 154 extends from first end 140 to a first arm bend 156 in direction 178 perpendicular to plate 114.

Second arm 158 is coupled to plate 114 at second end 142. Second arm 158 extends from second end 142 to a second arm bend 160 in direction 178.

In some embodiments, first plane 172 forms an angle other than 90 degrees with respect to plate plane 170. In some embodiments, elongate wire 116 is bent into other configurations according to the specific geometry of a particular embodiment of bag retaining fixture 110.

Elongate wire 116 also includes a third arm 162 and a fourth arm 164 in the embodiment of bag retaining fixture 110 shown in FIG. 3 and FIG. 4. Third arm 162 extends from first arm bend 156 to a third arm end 163 in a direction 180 towards plate 114. Forth arm 164 extends from second arm bend 160 to a fourth arm end 165 in direction 180 towards plate 114. Third and fourth arm 162 and 164 lie in a second plane 174 (FIG. 3) that intersects plate plane 170 at a third arm angle 176 of between about 75 degrees and about 85 degrees. This range of angles between second plane 174 and plate plane 170 has been shown to provide for pressure to be put on stack of paper bags 112, while allowing some give to third and fourth arm 162 and 164 so individual paper bags can be removed. In some embodiments, third arm angle 176 is about 80 degrees. A third arm angle 176 of 80 degrees between second plane 174 and plate plane 170 has been shown to provide for pressure to be put on stack of paper bags 112, while allowing some give to third and fourth arm 162 and 164 so individual paper bags can be removed.

An end piece 166 couples third arm 162 to fourth arm 164, as shown in FIG. 4. End piece 166 extends from third arm end 163 to fourth arm end 165. End piece 166 is the part of elongate wire 116 that presses stack of paper bags 112 between elongate wire 116 and bottom 137 of housing 120. End piece 166 puts pressure on stack of paper bags 112 in response to plate 114 being mounted to inner surface 124 of cabinet housing 120. End piece 166, in this embodiment, includes a half-rectangle-shaped bend 168, as shown in FIG. 4. Half-rectangle-shaped bend 168 provides for end piece 166 to put pressure on stack of paper bags 112, while also allowing room for fingers to separate and remove one paper bag from stack of paper bags 112 so the paper bag may be removed and filled.

FIG. 5 and FIG. 6 show an embodiment of a bag retaining fixture 210. Bag retaining fixture 210 can be used in place of bag retaining fixture 110 with bagging station 110 as shown in FIG. 1 and FIG. 2. FIG. 5 shows a cross section of cabinet 122 of FIG. 1 and FIG. 2, with bag retaining fixture 210 installed in cabinet 122 in place of bag retaining fixture 110. Bag retaining fixture 210 captures stack of paper bags 112 between bag retaining fixture 210 and bottom side 137 of cabinet housing 120. This keeps stack of paper bags 112 in place even as an individual paper bag is removed from stack of paper bags 112. FIG. 6 shows a top view of bag retaining fixture 210.

Bag retaining fixture 210 includes a plate 214 and an elongate wire 216 coupled to plate 214, as shown in FIG. 5 and FIG. 6. Plate 214 is rectangular-shaped in this embodiment, but this is not meant to be limiting. Plate 214 includes a plate front surface 230 and a plate rear surface 228 (FIG. 6). Plate 214 in this embodiment has two folded spacer edges 284 and 286 at either end of plate 214. Folded spacer edges 284 and 286 put space between back side 135 of cabinet housing 120, and plate 214, as shown in FIG. 5 and FIG. 6. Spacer edges 284 and 286 keep plate 214 spaced away from back side 135 so that there is room for first and second back portions 247 and 249, and first and second springs 251 and 253, as shown in FIG. 6 and explained herein. Plate 214 is coupled to housing 120 using two screws 288, as shown in FIG. 6. Elongate wire 216 protrudes from plate front surface 230.

Plate 214 is coupled to an inner surface of cabinet housing 120. In the embodiment shown in FIG. 5, plate 214 is coupled to an inner surface 126 of back side 135 of cabinet housing 120, but this is not meant to be limiting. Depending on the configuration of cabinet 122 and how it is mounted to or near bagging station 108, plate 214 of bag retaining fixture 210 can be mounted to any inner surface of cabinet housing 120. Plate 214 can be mounted to front side 134 of housing 120, to top 136 of housing 136, or to bottom 137 of housing 120, for example but not by way of limitation. Plate 214 is what holds elongate wire 216 in place, and what couples bag retaining device 210 to housing 120.

Elongate wire 216 is a structure formed of a semi-rigid elongate wire that is bent into a shape that will put pressure on stack of paper bags 112, to hold stack of paper bags 112 in place as individual bags are removed. Elongate wire 216 is rigid enough to hold its shape and put pressure on stack of paper bags 112, but flexible enough to allow individual bags to be removed from stack of paper bags 112. Elongate wire 216 includes a plurality of bends 232 (FIG. 6) that are designed to hold stack of paper bags 112 in place while allowing individual paper bags to be removed without scattering stack of paper bags 112. In some embodiments, elongate wire 216 is formed of rigid material such as metal or plastic with the bends preformed into the rigid material.

Elongate wire 216 includes a first end 240, and a second end 242 opposing first end 240. Plurality of bends 232 are in elongate wire 216 between first end 240 and second end 242. Elongate wire 216 is coupled to plate 214 such that elongate wire 216 protrudes from plate front surface 230 of plate 214 in a direction 278 away from back surface 228 of plate 214. Elongate wire 216 captures stack of paper bags 112 between elongate wire 216 and side 135 of cabinet housing 120, as shown in FIG. 5.

First end 240 and second end 242 are coupled to plate 214 using a first and a second spring 251 and 253. Elongate wire 216 has a first back portion 247 that extends from first end 240 to a first pass through bend 281, see FIG. 6. Elongate wire 216 also has a second back portion 249 that extends from second end 242 to a second pass through bend 282. Elongate wire 216 has a bag retaining section 215 that extends from first pass through bend 281 to second pass through bend 282. Elongate wire 216 passes through plate 214 at first hole 250 and second hole 252, with first back portion 247 extending along plate rear surface 228, first pass through bend 281 passing through first hole 252, second pass through portion 249 extending along plate rear surface 228, second pass through bend 282 passing through second hole 252, and bag retaining section 215 protruding from plate front surface 230 in a direction 278 away from plate rear surface 228. First back portion 247 and second back portion 249 extend along plate rear surface 228 in a direction parallel to plate top edge 246, in this embodiment.

First back portion 247 is coupled to plate rear surface 228 using a first spring 251. First spring 251 is positioned to extend parallel to plate top edge 246. First back portion 247 extends through first spring 251 with first back portion 247 extending along a first spring center axis 294. First back portion 247 is coupled to first spring 251. Both first spring 251 and first back portion 247 extend along plate rear surface 228. First spring 247 couples first back portion 247 of elongate wire 216 to plate 214. First back portion 247 of elongate wire 216 is coupled to first spring 251, and first spring 251 is coupled to plate 214. Having elongate wire 216 being coupled to plate 214 through first spring 251 allows elongate wire 216 to flex and bend and apply pressure to stack of paper bags 112 without breaking.

Second back portion 249 is coupled to plate rear surface 228 using second spring 253. Second spring 253 is positioned to extend parallel to plate top edge 246. Second back portion 249 extends through second spring 253 with second back portion 249 extending along a second spring center axis 295 (FIG. 6). Second back portion 249 is coupled to second spring 253. Both second spring 253 and second back portion 249 extend along plate rear surface 228. Second spring 249 couples second back portion 249 of elongate wire 216 to plate 214. Second back portion 249 of elongate wire 216 is coupled to second spring 253, and second spring 253 is coupled to plate 214. Having elongate wire 216 being coupled to plate 214 through second spring 253 allows elongate wire 216 to flex and bend and apply pressure to stack of paper bags 112 without breaking.

Bag retaining section 215 protrudes from plate front surface 230 in a direction 278 away from plate rear surface 228, as shown in FIG. 5 and FIG. 6. Bag retaining section 215 is the part of elongate wire 216 that presses stack of paper bags 212 between elongate wire 216 and side 137 of cabinet housing 120, as shown in FIG. 5. Bag retaining section 215 includes a first arm 254, an end piece 266, and a second arm 258. First arm 254 extends from first pass through bend 281 to a first arm end 283. Second arm 258 extends from second pass through bend 282 to a second arm end 285.

End piece 266 couples first arm 254 to second arm 258. End piece 266 extends from first arm end 283 to second arm end 285. End piece 266 is parallel to plate 214 and plate top edge 246 in this embodiment. End piece 266 presses stack of paper bags 112 between end piece 266 and side 137 of cabinet housing 120.

First arm 254 and second arm 258 are both curved in this embodiment. First arm 254 and second arm 258 curve towards each other. First arm 254 and second arm 258 curve towards each other, causing an end piece length 197 to be shorter than a distance 198 between first hole 250 and second hole 252, as shown in FIG. 6.

Elongate wire 216 is bent at first arm end 283 and second arm end 285. A first end piece angle 244 is about 90 degrees in this embodiment. A second end piece angle 245 is about 90 degrees in this embodiment. First end piece angle 244 and second end piece angle 245 of about 90 degrees creates a compact but strong bag retaining section 215 for pressing stack of paper bag 112 between bag retaining section 215 and side 137 of cabinet housing 122.

First and second spring 247 and 249 bias elongate wire 216 and end piece 266 towards bottom side 137 of housing 120, causing end piece 266 put pressure on stack of paper bags 112.

Bag retaining fixture 110 and 210 can each be mounted to an inner surface of cabinet 122 to hold stack of paper bags 112 in place. Cabinet 122 can be mounted in any orientation (horizontally, vertically, top side up, top side down, etc.) to bagging station 108 to store stack of paper bags 112. Cabinet 122 and bag retaining fixture 210 and 110 provide a means to hold stack of paper bags 112, and a means to keep stack of paper bags 112 in place as one or more individual paper bags is removed from stack of paper bags 112.

Figure 7:
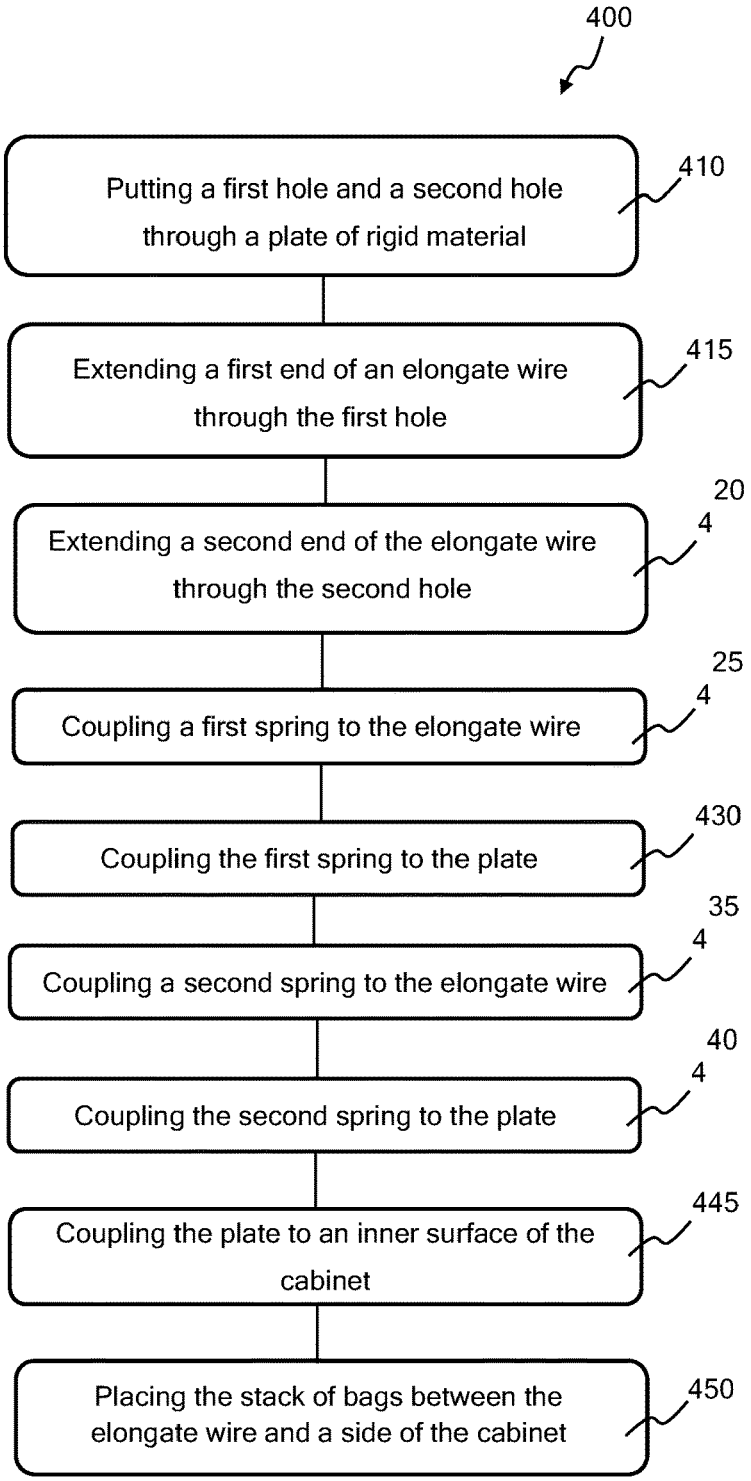
FIG. 7 illustrates a method of retaining a stack of paper bags in a cabinet.

FIG. 7 illustrates a method 400 of retaining a stack of bags in a cabinet. Method 400 includes an act 410 of putting a first hole and a second hole through a plate of rigid material. Method 400 includes an act 415 of extending a first end of an elongate wire through the first hole from a plate front surface of the plate to a plate rear surface of the plate, and an act 420 of extending a second end of the elongate wire through the second hole from the plate front surface of the plate to the plate rear surface of the plate. A bag retaining section of the elongate wire protrudes from the plate front surface of the plate.

Method 400 also includes an act 425 of coupling a first spring to the elongate wire, and an act 430 of coupling the first spring to the plate. And method 400 includes an act 435 of coupling a second spring to the elongate wire, and an act 440 of coupling the second spring to the plate. In some embodiments, coupling the first spring to the elongate wire includes sliding a first back portion of the elongate wire through the first spring along a first spring center axis. The first back portion extends from the first end of the elongate wire to a first pass through bend of the elongate wire. The first pass through bend passes through the first hole. In some embodiments, coupling the first spring to the elongate wire includes coupling the first end to the first spring. In some embodiment, coupling the first spring to the plate includes coupling the first spring to the plate rear surface such that the first spring and the first back portion extend along the plate rear surface in a direction parallel to a plate top edge.

In some embodiments, coupling the second spring to the elongate wire includes sliding a second back portion of the elongate wire through the second spring along a second spring center axis. The second back portion extends from the second end of the elongate wire to a second pass through bend of the elongate wire. The second pass through bend passes through the second hole. In some embodiments, coupling the second spring to the elongate wire includes coupling the second end to the second spring. In some embodiments, coupling the second spring to the plate includes coupling the second spring to the plate rear surface such that the second spring and the second back portion extend along the plate rear surface in a direction parallel to the plate top edge.

Method 400 includes an act 445 of coupling the plate to an inner surface of the cabinet, and an act 450 of placing the stack of bags between the elongate wire and a side of the cabinet. The elongate wire presses the stack of paper bag between the elongate wires and a side of the cabinet. In some embodiments, placing the stack of bags between the elongate wire and the side of the cabinet includes pressing the stack of bags between the bag retaining section and the side of the cabinet, wherein the bag retaining section extends from the first pass through bend to the second pass through bend.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A bag retaining fixture comprising:

a plate having a plate front surface, a plate rear surface opposing the plate front surface, and a plate top edge; and an elongate wire coupled to the plate, wherein the elongate wire comprises:

a first end;

a second end opposing the first end;

a first back portion extending from the first end to a first pass through bend, wherein the first back portion extends along the plate rear surface, and wherein the first pass through bend passes through the plate at a first hole;

a second back portion extending from the second end to a second pass through bend, wherein the second back portion extends along the plate rear surface, wherein the second pass through bend passes through the plate at a second hole, and wherein the first back portion and the second back portion extend along the plate rear surface in a direction parallel to the plate top edge;

and a bag retaining section that extends from the first pass through bend to the second pass through bend, wherein the bag retaining section protrudes from the plate front surface in a direction away from the plate rear surface, and wherein the bag retaining section comprises:

a first arm extending from the first pass through bend to a first arm end, wherein the first arm is curved;

a second arm extending from the second pass through bend to a second arm end, wherein the second arm is curved; and an end piece that extends from the first arm end to the second arm end, wherein the end piece is parallel to the plate top edge.

2. The bag retaining fixture of claim 1, further comprising a first spring coupled to the plate rear surface, wherein the first back portion extends through the first spring along a first spring center axis, and wherein the first back portion is coupled to the first spring.

3. The bag retaining fixture of claim 2, further comprising a second spring coupled to the plate rear surface, wherein the second back portion extends through the second spring along a second spring center axis, and wherein the second back portion is coupled to the second spring.

4. The bag retaining fixture of claim 1, wherein an end piece length is shorter than a distance between the first hole and the second hole.

5. The bag retaining fixture of claim 1, wherein a first end piece angle between the first arm and the end piece is about 90 degrees.

6. The bag retaining fixture of claim 5, wherein a second end piece angle between the second arm and the end piece is about 90 degrees.

7. A bagging station comprising:

a bagging station carousel;

a center piece coupled to a rotating platform, wherein the center piece comprises at least one side;

a center piece lid having a lid top surface and a lid bottom surface;

an opening through the center piece lid; and a cabinet for holding at least one bag coupled to the lid bottom surface beneath the opening, the cabinet comprising:

a cabinet housing, wherein the cabinet housing holds the at least one bag; and a bag retaining fixture coupled to an inner surface of the cabinet housing, the bag retaining fixture comprising:

a plate having a plate front surface; and an elongate wire coupled to and extending from the plate, wherein the elongate wire presses the at least one bag between the elongate wire and a cabinet housing side.

8. The bagging station of claim 7, wherein the elongate wire comprises:

a first end, wherein the first end is coupled to the plate;

a second end opposing the first end, wherein the second end is coupled to the plate;

a first arm extending from the first end to a first arm bend, wherein the first arm protrudes from the plate front surface; and a second arm extending from the second end to a second arm bend, wherein the second arm protrudes from the plate front surface.

9. The bagging station of claim 8, wherein the elongate wire further comprises:

a third arm extending from the first arm bend to a third arm end, wherein the third arm extends in a direction towards the plate;

a fourth arm extending from the second arm bend to a fourth arm end, wherein the fourth arm extends in the direction towards the plate; and an end piece that couples the third arm to the fourth arm, wherein the end piece presses the at least one bag between the elongate wire and the cabinet housing side.

10. The bagging station of claim 9, wherein the end piece extends from the third arm end to the fourth arm end, and wherein the end piece comprises a half-rectangularly-shaped bend.

11. The bagging station of claim 10, wherein the first and the second arms are parallel to each other and lie in a first plane, and wherein the first plane is perpendicular to a plate plane.

12. The bagging station of claim 11, wherein the third and the fourth arms lie in a second plane, and wherein the second plane intersects the plate plane at a third arm angle in the range of from about 75 degrees to about 85 degrees.

13. A method of retaining a stack of bags in a cabinet, the method comprising:

putting a first hole and a second hole through a plate of rigid material;

extending a first end of an elongate wire through the first hole from a plate front surface to a plate rear surface;

extending a second end of the elongate wire through the second hole from the plate front surface to the plate rear surface, wherein a bag retaining section of the elongate wire protrudes from the plate front surface of the plate;

coupling a first spring to the elongate wire;

coupling the first spring to the plate;

coupling a second spring to the elongate wire;

coupling the second spring to the plate;

coupling the plate to an inner surface of the cabinet; and placing the stack of bags between the elongate wire and a side of the cabinet.

14. The method of claim 13, wherein the coupling the first spring to the elongate wire comprises:

sliding a first back portion of the elongate wire through the first spring along a first spring center axis, wherein the first back portion extends from the first end of the elongate wire to a first pass through bend of the elongate wire, wherein the first pass through bend passes through the first hole; and coupling the first end to the first spring.

15. The method of claim 14, wherein the coupling the first spring to the plate comprises coupling the first spring to the plate rear surface, and wherein the first spring and the first back portion extend along the plate rear surface in a direction parallel to a plate top edge.

16. The method of claim 15, wherein the coupling the second spring to the elongate wire comprises:

sliding a second back portion of the elongate wire through the second spring along a second spring center axis, wherein the second back portion extends from the second end of the elongate wire to a second pass through bend of the elongate wire, wherein the second pass through bend passes through the second hole; and coupling the second end to the second spring.

17. The method of claim 16, wherein the coupling the second spring to the plate comprises coupling the second spring to the plate rear surface, and wherein the second spring and the second back portion extend along the plate rear surface in a direction parallel to the plate top edge.

18. The method of claim 17, wherein placing the stack of bags between the elongate wire and the side of the cabinet comprises pressing the stack of bags between the bag retaining section and the side of the cabinet, wherein the bag retaining section extends from the first pass through bend to the second pass through bend.

19. The method of claim 17, wherein the at least one bag is a stack of bags.

20. A bag retaining fixture comprising:

a plate having a plate front surface, a plate rear surface opposing the plate front surface, and a plate top edge; and an elongate wire coupled to the plate, wherein the elongate wire comprises:

a first end;

a second end opposing the first end;

a first back portion extending from the first end to a first pass through bend, wherein the first back portion extends along the plate rear surface, and wherein the first pass through bend passes through the plate at a first hole;

a second back portion extending from the second end to a second pass through bend, wherein the second back portion extends along the plate rear surface, and wherein the second pass through bend passes through the plate at a second hole;

a bag retaining section that extends from the first pass through bend to the second pass through bend, wherein the bag retaining section protrudes from the plate front surface in a direction away from the plate rear surface, and wherein the bag retaining section comprises:

a first arm extending from the first pass through bend to a first arm end, wherein the first arm is curved;

a second arm extending from the second pass through bend to a second arm end, wherein the second arm is curved; and an end piece that extends from the first arm end to the second arm end, wherein the end piece is parallel to the plate top edge;

and a first spring coupled to the plate rear surface, wherein the first back portion extends through the first spring along a first spring center axis, and wherein the first back portion is coupled to the first spring.

21. The bag retaining fixture of claim 20, further comprising a second spring coupled to the plate rear surface, wherein the second back portion extends through the second spring along a second spring center axis, and wherein the second back portion is coupled to the second spring.

* * * * *